United States Patent [19]

Backelandt et al.

[11] Patent Number: 4,699,694

[45] Date of Patent: Oct. 13, 1987

[54] PROCESS AND DEVICE FOR REGULATING THE QUANTITY OF METAL ELECTROLYTICALLY DEPOSITED ON A CONTINUOUSLY TRAVELLING BAND

[75] Inventors: Bernard Backelandt; Jean-Claude Gythiel, both of Teteghem; Daniel Piquet, Ruminghem, all of France

[73] Assignee: Usinor Aciers, Puteaux, France

[21] Appl. No.: 932,013

[22] Filed: Nov. 18, 1986

[30] Foreign Application Priority Data

Nov. 19, 1985 [FR] France ..... 8517095

[51] Int. Cl.[4] ..... C25D 7/06

[52] U.S. Cl. ..... 204/28; 204/211

[58] Field of Search ..... 204/28, 211, 228

[56] References Cited

U.S. PATENT DOCUMENTS 4,240,881 12/1980 Stanya ..... 204/28

FOREIGN PATENT DOCUMENTS 2347759 4/1975 Fed. Rep. of Germany ..... 204/28

688189 2/1953 United Kingdom ..... 204/28

*Primary Examiner*—T. M. Tufariello

*Attorney, Agent, or Firm*—Fay, Sharpe, Beall, Fagan, Minnich & McKee

[57] ABSTRACT

Process for regulating the quantity of metal electrolytically deposited on a continuously travelling band to be coated in a coating plant comprising a plurality of tanks filled with electrolyte. The process comprises determining experimental curves of the yield as a function of the strength of the supply current of each bridge of the plant, collecting (32) indications relating to the bridges in operation or out of operation, establishing analog values of the strength for each bridge and of the maximum strength of the current for all of the bridges, measuring the velocity of the travel of the band (37), establishing set values (39) relating to the quantity of metal to be deposited, measuring the total quantity of metal deposited by means of a gauge employing a periodic scanning, determining the lower and upper means of the quantity of metal measured by the gauge in each scan, and establishing a regulation model from the aforementioned data.

7 Claims, 8 Drawing Figures

PROCESS AND DEVICE FOR REGULATING THE QUANTITY OF METAL ELECTROLYTICALLY DEPOSITED ON A CONTINUOUSLY TRAVELLING BAND

The present invention relates to the technique of depositing an electrolytic coating on a continuously travelling metal band, and more particularly relates to the regulation of the deposition of metal by means of a micro data processor.

It is known for the purpose of tinning a band to cause this band to pass in succession through a plurality of tanks filled with an electrolyte.

The tin is supplied to the tinning plant in the form of bars placed on a copper support acting as an anode.

There may be mentioned by way of example a tinning plant comprising twelve successive tanks.

With two supports or bridges per surface of metal in each tank, there are in all twenty-four bridges per surface.

The number of bars of tin on each support is a function of the width of the band to be tinned.

The bars of tin which are in fact consumable electrodes are mounted on conductive slideways so that it is possible to replace them when they are worn out in a continuous manner without stopping the production line.

Placed in each tank are a lower rubber roller and A chromium-plated upper roller between which the band extends. They together form the cathode of the corresponding tank.

The bridges are supplied with dc current of 24 V, the current being limited to 4 500 A.

The rate of tin deposited is a function of the width of the band, the travelling speed of the latter and the total current which is divided between the various bridges in use.

The value of the current is given by the following equation derived from Faraday's law.

$$I = \frac{V \times 60 \times l \times E}{2.2 \times n}$$

v=velocity of the production line in m/min l=width of the band in metres

E=tinning rate in g/m$^2$ n=yield

In known plants, the operator regulates the intended tinning rate by directly acting on the total current (TI). He must first of all indicate or input the width of the band. The tinning rate is maintained constant by the regulation of the current at a value which is proportional to the velocity of the line. However, this regulation does not avoid undertinning and overtinning during intermediate conditions (changing velocity, changing the rate, cutting off or addition of a bridge).

Indeed, the quantity of tin deposited is equal to:

$$\sum_{i=1}^{i=n} K\, Ii/vi, \text{ where } i \text{ is the order number of the bridge}$$

In the stable state, all the velocities of passage under the bridges are identical, thus there is obtained:

$$\sum_{i=1}^{i=n} K\, Ii/vi = 1/v \sum_{i=1}^{i=n} K\, Ii = K/v\, I \text{ (total)}$$

However, in each transition, this equation is no longer true, since all the vi may be different, and therefore the quantity of tin may differ from the intended value by more than 20%.

In the recent past, the measurement of the tinning rate was effected as follows:

The operators inputed or inserted, by means of a table, a current reference as a function of the coating to be effected. The measurement was effected by a destructive inspection. The current was then re-adjusted. This measurement took between a few minutes and three quarters of an hour and these operations had to be recommenced several times before obtaining a satisfactory result.

In view of the inertia of the system, in short programs, the adjustment was often obtained at the end of the operation. Moreover, in order to avoid disputes, tinning rates were aimed at right from the start which were higher than the nominal rate. Consequently, the tinning operation was excessively costly.

More recently, a continuously measuring gauge has been installed. This gauge permits re-transcribing the measurement in the form of a graph by means of a screen. The operator can therefore immediatly correct the errors.

This gauge operates in the following manner:

The measurement is based on the principle of the fluorescence X. The gauge uses two sources of curium 244 having a radioactive period of 17.6 years. The energe liberated by the source causes an emission of fluorescent rays coming from the iron, a part of which is absorbed by the tin. The tin deposited is calculated by determining the remaining quantity of radiation.

The signal is processed as follows:

Conversion of the exponential signal delivered by the cells into a linear signal which is proportional to the coating.

Calculation of the difference between the measurement and the intended nominal rate.

Possible correction of the value of the signal by more or less 5% depending on the ageing of the sources for example.

Lastly, a microcomputer records the signals and transmits them to a cathode-ray screen located on the tinning production line.

The gauge effects a scanning about every 30 seconds. Simultaneously, there appear the transverse profiles of the coating, the instantaneous measured mean values and those of the last scanning, and the minimum threshold allowed by the standards presently in force for the tinning operations, such as EURONORM. For purposes of comparison, the last recorded profile remains on the screen.

With the known techniques mentioned hereinbefore, there is the problem of the variation in the tinning rate for each velocity transition.

An object of the invention is therefore to provide a process and a device for regulating the electrolytic deposition of a metal coating on a continuously travelling band of metal which overcomes these drawbacks by taking into account the quantities of metal deposited by each bridge and by adapting the regulations on the deposition line in accordance with these quantities.

The invention therefore provides a process for regulating the quantity of a metal electrolytically deposited on a continuously travelling band to be coated in a deposition plant comprising a plurality of tanks filled with an electrolyte, the band passing round a conductive roller constituting a cathode associated with each tank and the coating metal being supplied by bars of said metal carried by conductive bridges forming anodes disposed in each tank in a part of the path of the band in said tank, said process comprising calculating upon each displacement of the band between two successive bridges, the deposit of metal of each bridge as a function of the current supplied to this bridge, the velocity of the band and the yield of the bridge, separately following each length of band equal to the distance between two successive bridges by cumulating the successive deposits of metal, ascertaining the total amount of the deposit under the last bridge supplying current so as to determine the strength of current required under this bridge to complete the deposit of metal, determining the total current strength required for obtaining the desired strength under this last bridge, and upon the acquisition of a mean measurement over the full width of the band, calculating by taking into account the transfer distance the differences between this mean value and a pre-established set value by determining a coefficient correcting the theoretical yields of the deposit of metal under each bridge.

According to a particular feature of the invention, the process defined hereinbefore further comprises the following steps, determining experimental curves of the yield as a function of the strength of the supply current of each bridge of the plant, collecting indications relating to bridges in operation or out of operation, establishing analog values of the current strength at each bridge and of the maximum strength of the current for all of the bridges, measuring the velocity of travel of the band, establishing set values relating to the quantity of metal to be deposited, measuring the total quantity of metal deposited by means of a gauge employing a periodical scanning, determining the lower and upper means of the quantity of metal measured by the gauge in each scan, and establishing with the aforementioned data a regulation model.

A better understanding of the invention will be had from the following description which is given solely by way of example with reference to the accompanying drawings, in which:

FIG. 1 shows a tinning tank which is part of the construction of a tinning plant to which the invention is applied.

Figure 1:
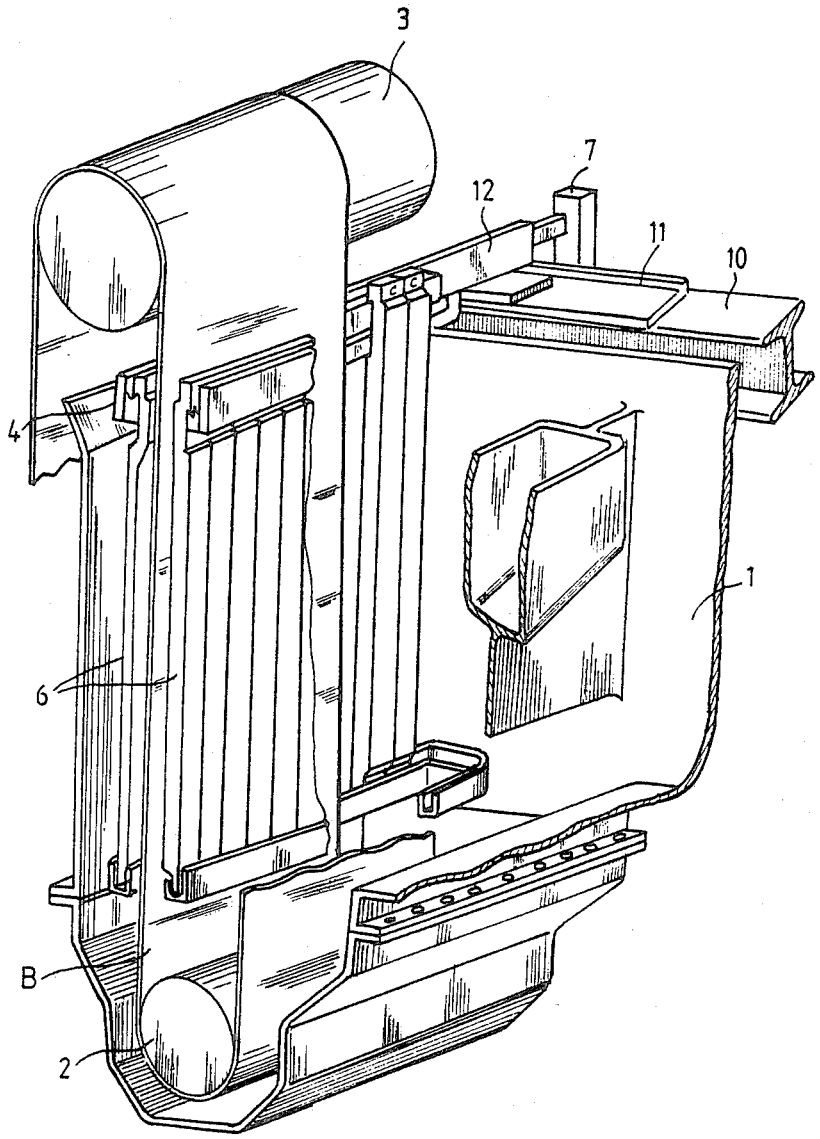
FIG. 1 is a diagrammatic perspective view, with a part cut away, of a tinning tank which is part of the construction of a tinning plant to which the invention is applied.

However, it must be mentioned that the invention is also applicable to the electrolytic deposition plants for depositing metals other than tin, such as chromium, copper, or other metal.

The tank or reservoir 1 contains an electrolyte (not shown).

Mounted to rotate in the bottom of the tank is a roller 2 around which continuously passes a band B to be coated with a coating of tin. The roller 2 is made for example from rubber. Disposed above the tank 1 is a second roller 3, for example chromium plated, of conductive material which puts the band under tension and transfers it into the tank 1 from an identical tank (not shown) which, together with other tanks of the same type, are disposed on the upstream and downstream sides of the tank 1 and are part of the tinning plant.

The roller 3 performs the function of a cathode associated with the tank 1.

A wiping roller (not shown) urges the band B against the roller 3 so as to avoid formation of electric arcs.

The band B passes into the tank 1 between two pairs of supports 4 and 5 (FIG. 2) formed by copper bars on which are disposed in side-by-side relation vertical tin bars 6 whose foot portions are engaged in a U-section guide 7.

The copper bars 4 and 5 form slideways for the tin bars and are connected to a corresponding current supply bar 7.

The band B therefore travels through two passages formed by the tin bars 6 carried by their corresponding supports 4 and 5 respectively provided on its descending and rising path in the tank 1 filled with electrolyte.

The supports or bridges 4 and 5, and the tin bars 6 perform the function of an anode of the device.

The tank arranged in this way is carried by a frame 10 which also carries the other tanks of the plant(not shown).

A member 11 of insulating material is interposed between the frame and the connection 12 of the supports 4, 5 to the current supply bar 7.

Figure 3:
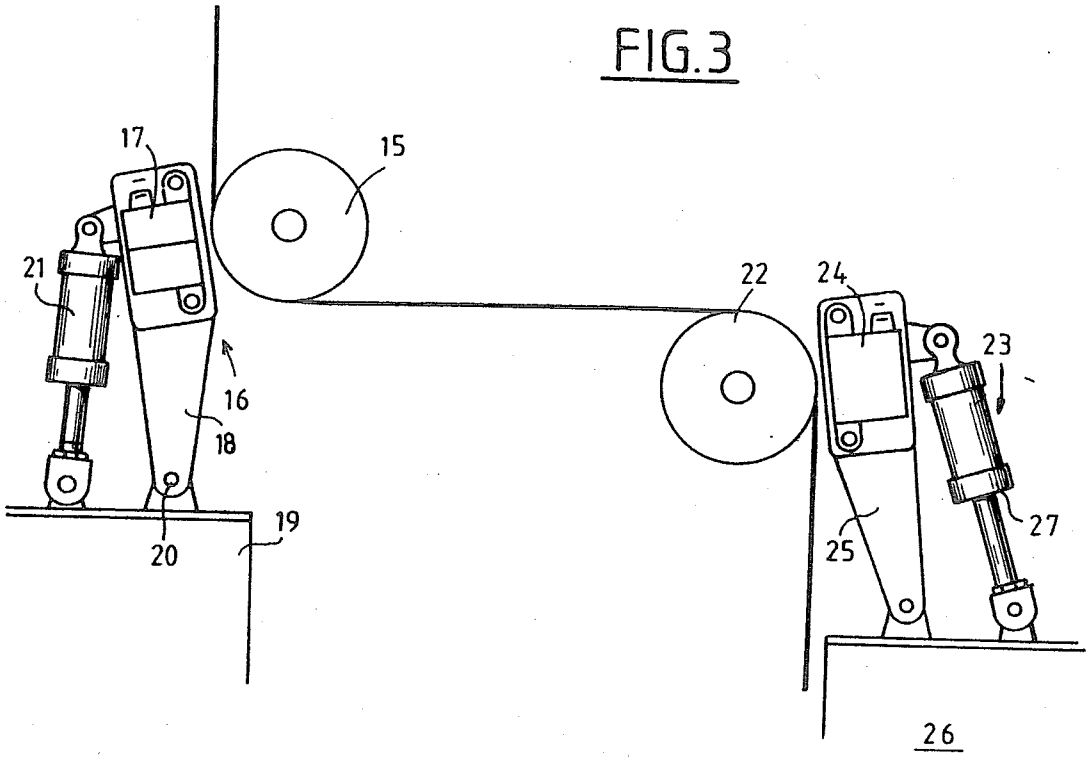
FIG. 3 is a diagrammatic view showing the placement of the gauges measuring the tinning rate in a plant to which the invention is applied.

Disposed on the downstream side of the last tank of the plant is a gauge formed by two cells disposed in the manner represented in FIG. 3.

At the outlet end of the plant, the band B, on the two surfaces of which has been deposited a coating of tin, passes round a deflector roller 15 in the front of which is disposed a first cell 15 adapted to measure the coating of tin on a first surface of the loop of band B. The cell 16 comprises a source 17 of curium 244 placed on a support 18 which is pivotally mounted on a stand 19 and is movable about its pivot pin 20 by a pneumatic jack 21.

The band 8 then passes round a second deflector roller 22 in front of which is disposed a second cell 23 similar to the cell 16 and adapted to measure the coating of tin on the opposite surface of the band B.

This cell also includes a source 24 of curium 244 placed on a support 25 which is pivotally mounted on a stand 26 and is shifted by a pneumatic jack 27.

The outputs (not shown) of the two cells 16 and 23 of the gauge are connected to corresponding inputs of the processing circuit of FIG. 4 which will now be described.

Figure 2:
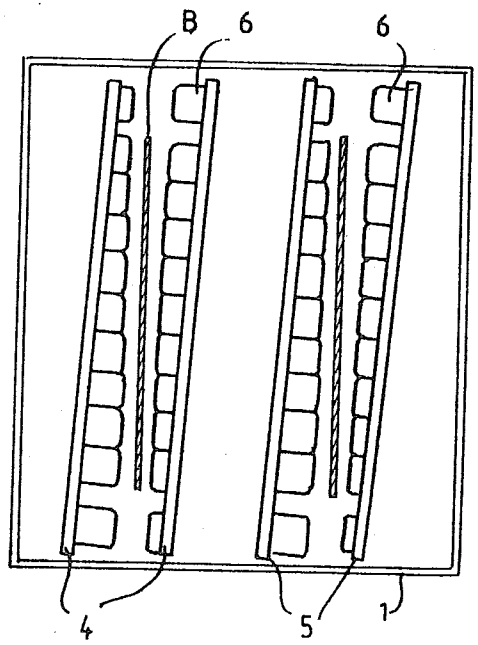
FIG. 2 is a diagrammatic plan view of the tank of FIG. 1.

This circuit comprises an analog-digital and digital-analog converter 30, for example of the type ADAC 735 which comprises, for a tinning plant having twelve tinning tanks, fourty-eight analog inputs 31 relating to the strength of the current supplied to the supports of all the tanks, such as the bridges 4, 5 of the tank of FIGS. 1 and 2.

The converter 30 further comprises two analog inputs 32 adapted to receive data concerning the position of the cells 16, 23 of the gauges and two analog inputs 33 adapted to receive data relating to the mean values of the deposits of tin on the two surfaces of the band.

The converter further comprises an analog input 34 for receiving signals concerning the width of the treated band B, two analog inputs 35 concerning the lower and upper maximum current strengths and two analog outputs relating to the lower and upper total current strengths to be divided between the bridges of the plant.

The converter 30 is connected to a multiple conductor bus 36.

Figure 4:
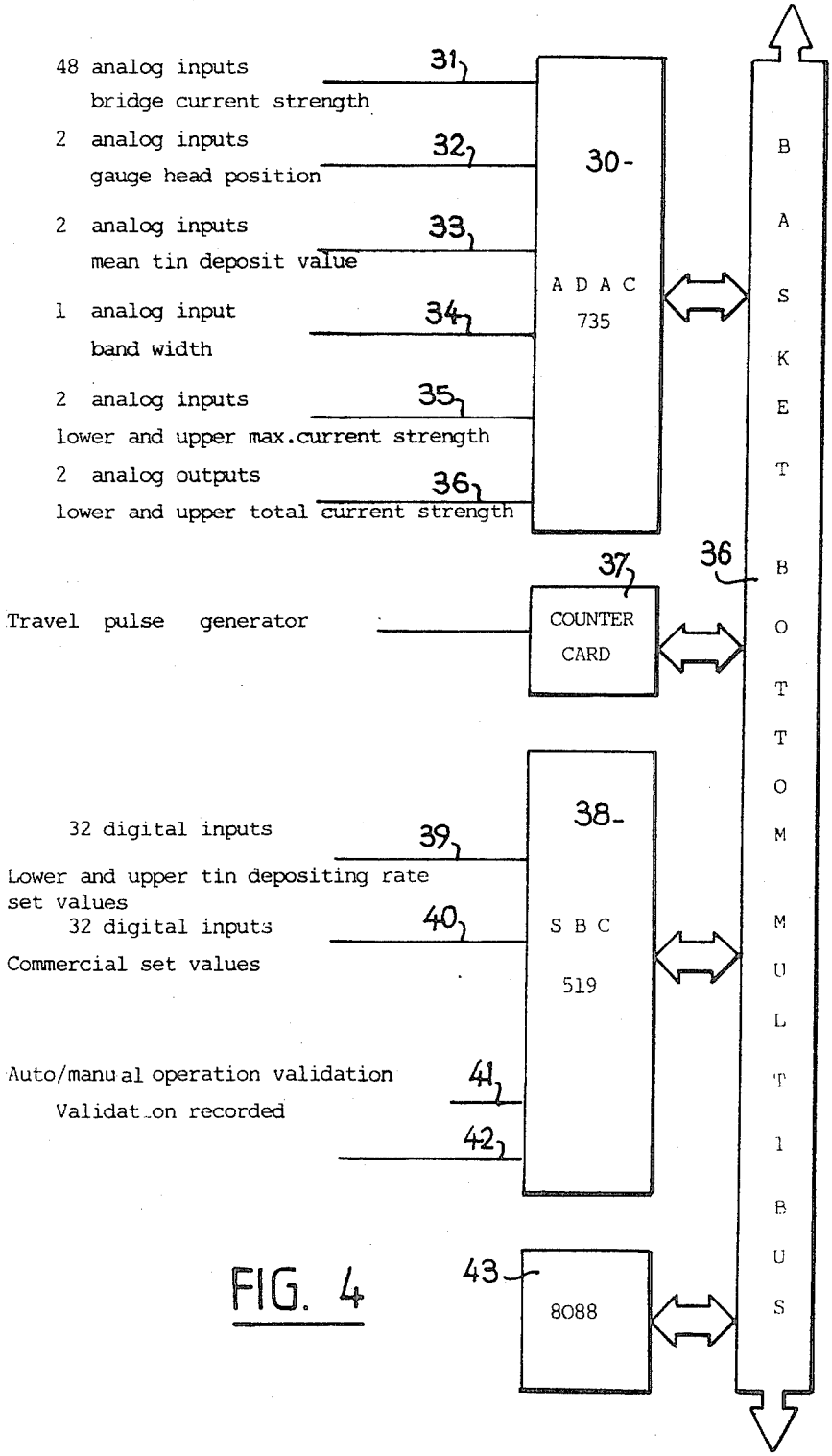
FIG. 4 is a block diagram of a circuit processing data relating to the coating applied on the sheet and establishing correction coefficients.

The circuit of FIG. 4 further comprises a counter 37 whose input is connected to the output of a generator of pulses related to the travel of the band B (not shown) and which is also connected to the bus 36, an interface circuit 38 of the type SBC 519 manufactured and sold by the firm Intel, having thirty-two digital inputs 39 relating to the lower and upper set values of the tinning rate to be obtained, thirty-two digital inputs 40 relating to the commercial set value, an input 41 for the validation of the automatic/manual operation and an input 42 for the validation of the set value. The circuit 38 is also connected to the bus 36.

The circuit of FIG. 4 comprises a microprocessor 43 of the type Intel 8088, for example, connected to the bus 36 and adapted to control the modifications of the tinning rates to be deposited in the various tanks of the plant, as a function of the data it receives.

The operation of the plant will now be described with reference to FIG. 4 and to the flow charts of FIGS. 5 to 7.

A first stage of operation of the plant is the stage for acquiring the data relating to the operation in process.

The converter 30 receives at its fourty-eight inputs measurements of strength of current on the bridges 4, 5 of the twelve tanks of the plant.

Figure 5:
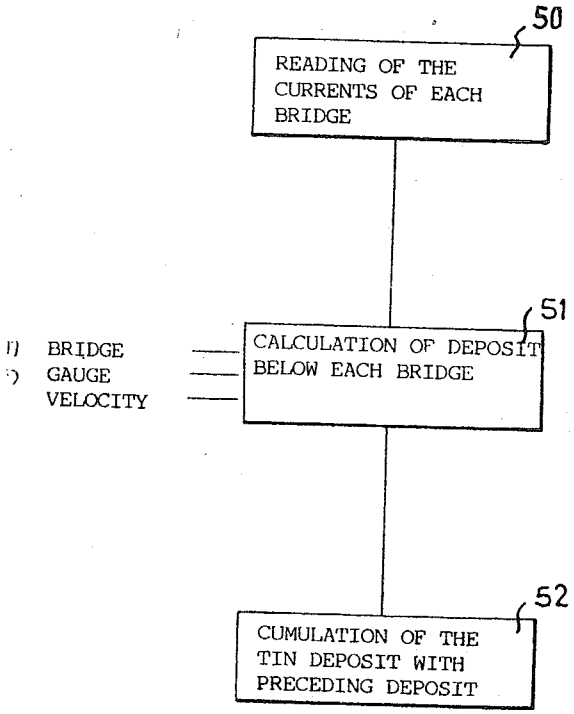
FIG. 5 is a flow chart of the operations for the acquisition of the data relating to the tin depositing rates.

In the course of the stage 50 of the flow chart of FIG. 5, the converter 30 reads the currents on each of the bridges. These current strength data are transmitted to the microprocessor 43 which, in the course of stage 1, calculates the values of the tin deposits below each bridge, bearing in mind the information concerning the velocity of the travel of the band delivered by the counter 37, the yield of each bridge and the position of the gauge representing the width of the band, these two data being delivered by the converter 30.

In the course of stage 52, the microprocessor 43 cumulates the data relating to the tin deposit being effected with the preceding deposit.

Figure 6:
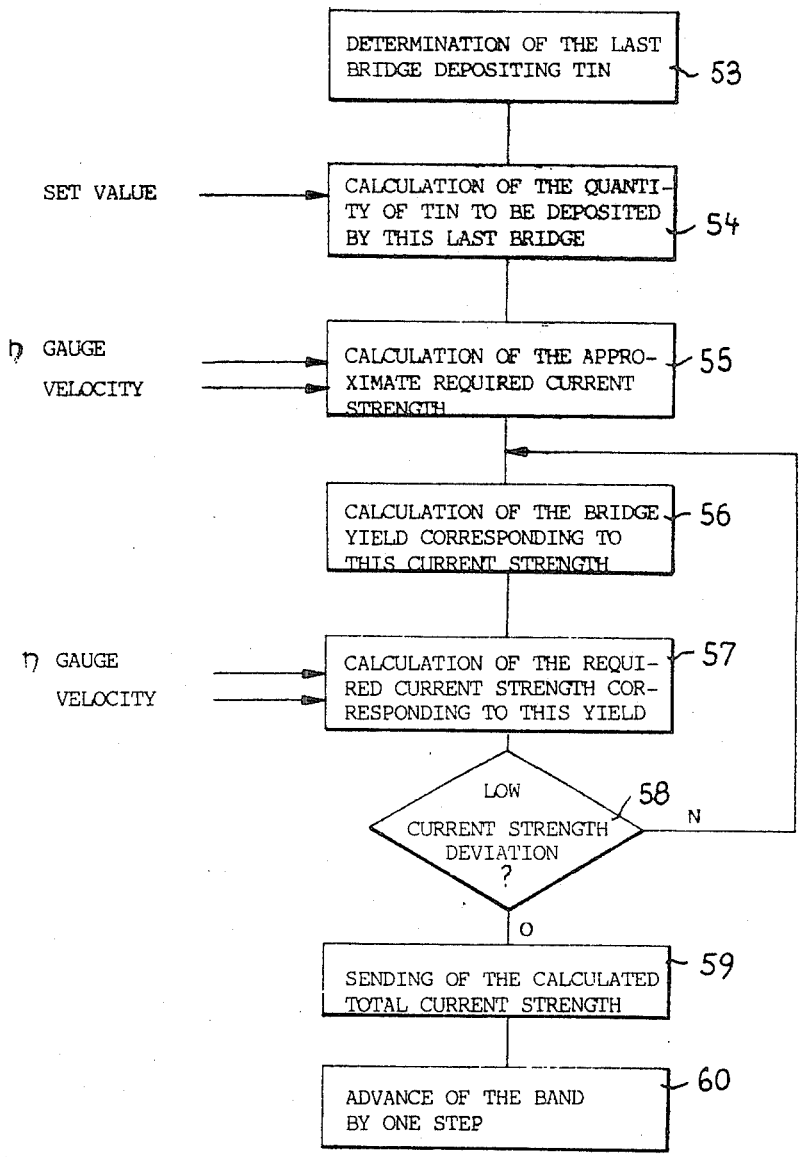
FIG. 6 is a flow chart of the rapid loop controlling the operations for calculating the deposit in respect of each bridge.

Then, as shown in the flow chart of FIG. 6, there is a determination of the last bridge depositing tin, This operation is carried out in the course of stage 53 of the flow chart relating to the "rapid loop" of FIG. 6.

The information relating to the last bridge depositing tin in the course of a scanning of the gauge is received at the analog input 31 of the converter 30.

In the course of stage 54, there is a calculation of the quantity of tin to be deposited by the last bridge by means of data concerning the lower and upper set tin rates to be obtained inserted by the operator at the inputs 39 of the interface circuit 38. Then, in the course of stage 55, the microprocessor 33 calculates the approximate current strength required as a function of the data concerning the quantity of tin to be deposited by the last bridge and data concerning the width of the band, the value of the coating measured by the gauge and the velocity of travel of the band, which it receives through the bus 36 from the converter 30 and the counter 37.

Figure 8:
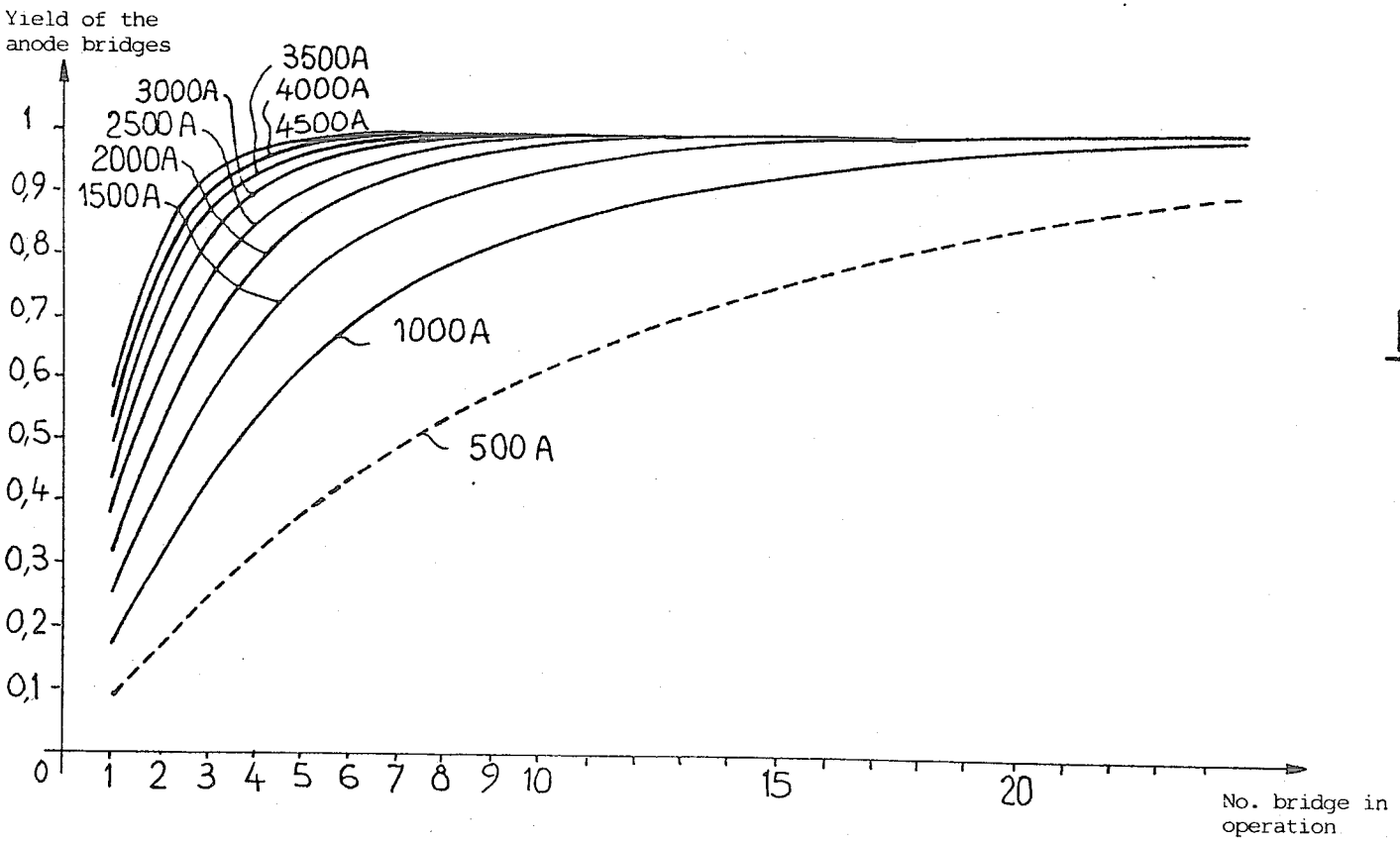
FIG. 8 is a group of yield curves of the bridges of a plant in respect of various supply currents.

In the course of stage 56, the microprocessor 43 calculates the yield of the bridge by means of current strengths calculated in the course of stage 55 by means of pre-established curves represented in FIG. 8.

Then, in the course of stage 57, the microprocessor calculates the required current strength corresponding to the yield determined in the course of stage 56, by taking into account the value of the coating measured by the gauge and the velocity of travel of the band.

In the course of stage 58, there is an interrogation concerning the difference between the required current strength and the current strength axially applied to the last bridge.

If the difference is small, there are sent in the course of stage 59 signals corresponding to the calculated total or overall current strength which appear at the analog outputs 36 of the converter 30, this current strength being divided between the various bridges of the plant.

In the course of stage 60, the band is made to advance by one step or pitch.

If the response to the interrogation of the stage 58 is in the negative, the calculations of the stages 56 and 57 based on the data concerning the tin deposit by a bridge located on the downstream side are repeated until the current strength difference is small.

Figure 7:
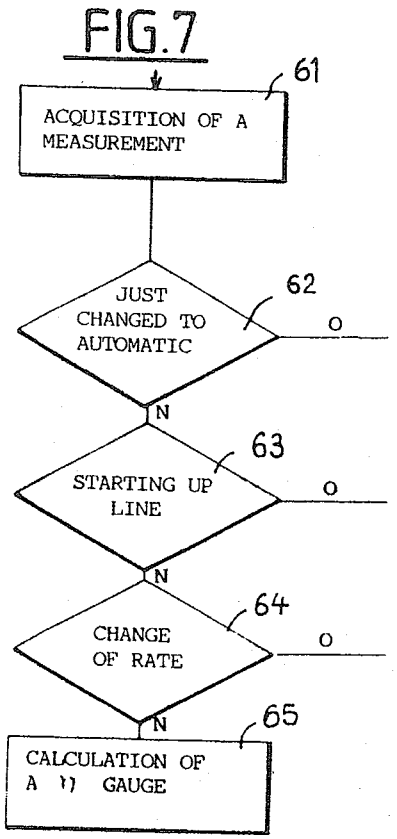
FIG. 7 is a flow chart controlling the gauge return.

The flow chart of FIG. 7 is a "slow loop" flow chart which controls the deviation corrections.

The acquisition of a measurement effected in the course of stage 61 is the reading of the mean value of the tin deposit effected by the converter 30 of FIG. 4 at each end of a scan of the gauge of FIG. 3.

This stage is followed by an interrogation stage 62 relating to the passage of the plant to automatic operation.

If the response is in the negative, one passes to an interrogation stage 63 relating to the starting up of the production line.

If the response to this new interrogation is in the negative, one proceeds to a third interrogation in the course of stage 63, as concerns the change in the tin deposit rate.

In the case of a negative response, the microprocessor 43 proceeds, in the course of stage 65, to the calculation of a gauge yield, i.e. of the ratio between the tin deposit measured by the gauge and the deposit to be obtained.

If the responses to the three preceding interrogations are in the affirmative, a scanning of the gauge is allowed to be effected and new interrogations are carried out.

Meanwhile, the response in the affirmative to the interrogation relating to the passage to automatic operation causes the validation of the automatic operation.

The affirmative response to the interrogation relating to the starting up of the production line actuates the pulse generator (not shown) which is associated with the counter 37 of FIG. 4.

The affirmative response to the interrogation of the stage 64 causes the validation of the set value by means of the interface circuit 38.

The process just described has the following advantages over known processes.

It permits taking into account all the transitions such as the variation in velocity of the travel of the band, stoppages and the putting of the bridges into operation.

It takes into account the yield of the electrolyte below each bridge, which permits having high precision in the direct obtainment of the good tinning upon each change in the set value.

This is of particular importance in the case of thin coatings or when the maximum strength of the bridges is low, since there are then yields which may be very low on the first bridges.

The current corrections are also low in absolute value and the interventions of the operator are more precise.

Lastly, it permits the obtainment of a small difference or deviation between the obtained tin deposit and the set value.

There will be given by way of example hereinafter the procedure of the operations for regulating the tin deposit in a tinning plant having twelve tanks and twenty-four bridges.

A) Input of the data

Velocity of the production line
Width of the band
Intended tinning rate
Current delivered per bridge B) Calculation of the number of theoretical bridges It must first of all be known that, each time the program is completed, the band has travelled through about 4 metres. This corresponds to one program step and to the distance between the bridge N and the bridge N+1.

In respect of the first step N=1 and for each step 1 is added to N. Consequently, for each step there will be an instruction to put an additional downstream bridge at the maximum possible current strength.

C) Calculation of the tin deposited per bridge

For each step, the theoretical amount of tin deposited below each bridge will be calculated.

Configuration example

| STEP | BRIDGE No. 1 | 2 | 3 | 4 | 5 | 6 | 24 |
|---|---|---|---|---|---|---|---|
| 1 | 4500 A 0.5 g/m$^2$ | 0 | 0 | 0 | 0 | 0 | 0 |
| 2 | 4500 A 0.5 g/m$^2$ | 4500 A 1 g/m$^2$ | 0 | 0 | 0 | 0 | 0 |
| 3 | 4500 A 0.5 g/m$^2$ | 4500 A 1 g/m$^2$ | 4500 A 1.5 g/m$^2$ | 0 | 0 | 0 | 0 |

In order to simplify the example, it will here be taken as a principle that a bridge theoretically deposits 0.5 g/m$^2$ of tin on the metal.

D) Test concerning the tinning rate obtained below the last bridge

When the calculation of the deposited tin has been effected, the tinning rate obtained below the last bridge put at the maximum current strength will be checked. There are two possible treatment cases, depending on whether the tinning rate is higher or lower than that intended. In the numerical applications, this maximum current strength is at 4500 A.

E) Regulation for a tinning rate higher than the intended tinning rate if not an addition of a bridge In the first case, there will be calculated a regulation current (IC) which will be applied to the last bridge.

In reverting to the preceding example and in assuming that the intended tinning rate (TV) is 1.8 g/m$^2$, it will be noticed in step 4 that the calculated tinning rate (TC=2 g/m$^2$) is higher than the intended rate TV. The correction C will then be calculated.

$$C = TC - TV$$

The current IC required at the bridge 4 for obtaining 1.8 g/m$^2$ will be deduced therefrom.

In the second case, additional bridges will be added so as to reach the first case.

F) Edition of the results

When the calculations have finished, the required current is delivered.

Complete table of the regulation of the tin deposits in a tinning plant having twelve tanks incorporating the preceding example (TV=1.8 g/m$^2$).

| STEP | BRIDGE No. 1 | 2 | 3 | 4 | 5 | 6 | 24 |
|---|---|---|---|---|---|---|---|
| 1 | 4500 A 0.5 g/m$^2$ | 0 | 0 | 0 | 0 | 0 | 0 |
| 2 | 4500 A 0.5 g/m$^2$ | 4500 A 1 g/m$^2$ | 0 | 0 | 0 | 0 | 0 |
| 3 | 4500 A 0.5 g/m$^2$ | 4500 A 1 g/m$^2$ | 4500 A 1.5 g/m$^2$ | 0 | 0 | 0 | 0 |
| 4 | 4500 A 0.5 g/m$^2$ | 4500 A 1 g/m$^2$ | 4500 A 1.5 g/m$^2$ | 2700 A 1.8 g/m$^2$ | 0 | 0 | 0 |
| 5 | 4500 A 0.5 g/m$^2$ | 4500 A 1 g/m$^2$ | 4500 A 1.5 g/m$^2$ | 2700 A 1.8 g/m$^2$ | 0 A 1.8 g/m$^2$ | 0 | 0 |
| 6 | 4500 A 0.5 g/m$^2$ | 4500 A 1 g/m$^2$ | 4500 A 1.5 g/m$^2$ | 2700 A 1.8 g/m$^2$ | 0 A 1.8 g/m$^2$ | 0 A 1.8 g/m$^2$ | 0 |
| 7 | 4500 A 0.5 g/m$^2$ | 4500 A 1 g/m$^2$ | 4500 A 1.5 g/m$^2$ | 2700 A 1.8 g/m$^2$ | 0 A 1.8 g/m$^2$ | 0 A 1.8 g/m$^2$ | 0 |
| 23 | 4500 A 0.5 g/m$^2$ | 4500 A 1 g/m$^2$ | 4500 A 1.5 g/m$^2$ | 2700 A 1.8 g/m$^2$ | 0 A 1.8 g/m$^2$ | 0 A 1.8 g/m$^2$ | 0 |
| 24 | 4500 A 0.5 g/m$^2$ | 4500 A 1 g/m$^2$ | 4500 A 1.5 g/m$^2$ | 2700 A 1.8 g/m$^2$ | 0 A 1.8 g/m$^2$ | 0 A 1.8 g/m$^2$ | 0 A 1.8 g/m$^2$ |
| 25 | 4500 A | 4500 A | 4500 A | 2700 A | 0 A | 0 A | 0 A |

-continued

| STEP | BRIDGE No. 1 | 2 | 3 | 4 | 5 | 6 | 24 |
|---|---|---|---|---|---|---|---|
| | 0.5 g/m² | 1 g/m² | 1.5 g/m² | 1.8 g/m² | 1.8 g/m² | 1.8 g/m² | 1.8 g/m² |

G) Change of step

When the current has been delivered, one passes to the following step:

P+1

H) New data

The new data are taken into account.

I) Tin gauge measurement

At this point, the measurement of the rate of tinning actually deposited (MJ) intervenes.

This will permit the determination of the new gauge yield (RJ) which will intervene in the calculations of the following step.

$RJ - \frac{3}{4}1 - (MJ/TV)$ (The coefficient $\frac{3}{4}$ is for moderating the correction of the yield).

The real measurement of the rate of tinning deposited does not intervene for each step but for each scan of the gauge.

What is claimed is:

1. A process for regulating the quantity of a metal electrolytically deposited on a band to be coated continuously travelling through a depositing plant comprising a plurality of tanks filled with electrolyte, the band passing round a conductive roller forming a cathode associated with each tank and the coating metal being supplied by bars of said metal carried by conductive bridges forming anodes and disposed in each tank in a part of the path of travel of the band in said tank, said process comprising calculating, for each displacement of the band between two successive bridges, the metal deposit of each bridge as a function of the strength of the supply current for said bridge, the velocity of the band and the yield of the bridge, separately following each length of band, equal to the distance between two successive bridges, in cumulating the successive metal deposits, establishing the accumulated amount of deposit below the last bridge supplying current so as to determine the required current strength of said last bridge to complete the deposit of metal, determining the total current strength required for obtaining the desired current strength of said last bridge, and, upon each acquisition of a mean measurement throughout the width of the band, calculating, while taking into account the transfer distance, the difference between said mean value and a pre-established set value with a determination of a coefficient correcting the theoretical yields of the metal deposit below each bridge.

2. A process according to claim 1, further comprising the following steps, determining experimental curves of the yield as a function of the supply current strength of each bridge of the plant, collecting indications relating to the bridges in operation or out of operation, establishing analog values of the current strength in respect of each bridge and of the maximum strength of the current relating to all of the bridges, measuring the velocity of the travel of the band, establishing set values relating to the quantity of metal to be deposited, measuring the total quantity of metal deposited by means of a gauge having a periodic scanning, determining upper and lower means of the quantity of metal measured by the gauge in each scan, and establishing a regulation model from the aforementioned data.

3. A process according to claim 1, wherein the metal whose electrolytic deposition is controlled is tin.

4. A process according to claim 1, wherein the metal whose electrolytic deposition is controlled is chromium.

5. A process according to claim 1, wherein the metal whose electrolytic deposition is controlled is copper.

6. A process according to claim 1, wherein the electrolytic deposit of the coating of the band occurs on both sides of the band and the regulation of the deposit is achieved from data delivered by a gauge comprising two cells each disposed on a respective side of the band at an outlet end of the electrolytic deposition plant.

7. A device for regulating the quantity of a metal electrolytically deposited on a band to be coated in an electrolytic deposition plant through which the band travels continuously, said plant comprising a series of tanks filled with electrolyte, through which tanks the band passes in succession, each tank being combined with a conductive roller which acts as a cathode, conductive bridges, bars of the metal to be deposited supported by the bridges and acting as anodes and positioned in the respective tank in a part of a path of travel of the band in the tank, means for supplying current to each bridge and the bar carried thereby, and at least one gauge including band surface scanning means located adjacent an outlet end of the plant for detecting the total amount of metal deposited by the bars of the tanks on an upstream side of the gauge relative to the direction of travel of the band through the plant , a counter for measuring the velocity of the travel of the band through the plant, said device comprising a microprocessor having inputs and outputs, an analog-digital, digital-analog converter having inputs connected to said means supplying current to each bar and to said gauge and outputs connected to said microprocessor for receiving analog data relating to the strength of the supply currents of the bridges of the plant, to the value of the metal deposit measured by the gauge, to the position of the gauge, to the width of the band to be coated, and to lower and upper maximum strengths of the supply currents of the bridges, said converter transmitting said data in a digital form through its outputs to the microprocessor to an input of which there is also connected the counter, and an interface circuit for transmitting to said microprocessor data relating to lower and upper set values of the metal depositing rate, to validation of automatic/-manual operation and to the validation of the set values, said converter further comprising analog outputs for transmitting to the plant instructions relating to the strength of the supply currents to be applied to the bridges of the plant worked out by the microprocessor as a function of the data received thereby.

* * * * *